US007389643B2

(12) United States Patent
Simons et al.

(10) Patent No.: US 7,389,643 B2
(45) Date of Patent: Jun. 24, 2008

(54) INBOARD RADIAL DUMP VENTURI FOR COMBUSTION CHAMBER OF A GAS TURBINE

(75) Inventors: Derrick Walter Simons, Greer, SC (US); Thomas Charles Amond, III, Mauldin, SC (US); Ajay Kumar Gupta, Alpharetta, GA (US)

(73) Assignee: General Electric Company, Schenectady, NY (US)

( * ) Notice: Subject to any disclaimer, the term of this patent is extended or adjusted under 35 U.S.C. 154(b) by 480 days.

(21) Appl. No.: 11/045,057

(22) Filed: Jan. 31, 2005

(65) Prior Publication Data

US 2006/0168967 A1 Aug. 3, 2006

(51) Int. Cl.
*F23R 3/42* (2006.01)

(52) U.S. Cl. ..... 60/772; 60/737; 60/752

(58) Field of Classification Search ..... 60/737, 60/748, 746, 747, 732, 733, 772, 752, 754
See application file for complete search history.

(56) References Cited

U.S. PATENT DOCUMENTS 2,447,482 A * 8/1948 Arnold ..... 60/753
4,292,801 A * 10/1981 Wilkes et al. ..... 60/776
4,413,477 A * 11/1983 Dean et al. ..... 60/757
4,420,929 A * 12/1983 Jorgensen et al. ..... 60/733
4,787,208 A * 11/1988 DeCorso ..... 60/732
4,982,570 A 1/1991 Waslo et al.
5,127,221 A * 7/1992 Beebe ..... 60/733
5,253,478 A 10/1993 Thibault, Jr. et al.
5,309,710 A * 5/1994 Corr, II ..... 60/794
5,487,275 A * 1/1996 Borkowicz et al. ..... 60/747
5,575,146 A 11/1996 Borkowicz et al.
5,735,126 A * 4/1998 Schulte-Werning ..... 60/732
6,354,072 B1 3/2002 Hura
6,405,523 B1 6/2002 Foust et al.
6,427,446 B1 * 8/2002 Kraft et al. ..... 60/737
6,430,932 B1 8/2002 Martling et al.
6,446,438 B1 * 9/2002 Kraft et al. ..... 60/737
6,722,132 B2 4/2004 Stuttaford et al.
2004/0050057 A1 3/2004 Bland et al.
2004/0172949 A1 9/2004 Stuttaford

* cited by examiner

*Primary Examiner*—Ted Kim
(74) *Attorney, Agent, or Firm*—Nixon & Vanderhye P.C.

(57) ABSTRACT

A double wall venturi chamber having a converging section, a diverging section and a cylindrical section wherein said chamber defines a venturi zone in which compressed air, fuel and combustion products flow downstream through converging section, diverging section and cylindrical section, and has a cooling gas passage between the walls of the venturi chamber, a least one cooling gas inlet in an outlet wall of the venturi chamber, and at least one cooling gas outlet in an inner wall of the venturi chamber, wherein said cooling gas outlet is in at least one of the diverging and the cylindrical section, and the outlet is downstream of the at least one cooling gas inlet and upstream of an axial end of the chamber.

20 Claims, 2 Drawing Sheets

INBOARD RADIAL DUMP VENTURI FOR COMBUSTION CHAMBER OF A GAS TURBINE

BACKGROUND OF THE INVENTION

This invention relates to gas turbine combustors and, in particular, to combustors having primary and secondary combustion chambers divided by a venturi.

A combustor in an industrial gas turbine typically has dual combustion chambers. A venturi typically divides the combustor into primary and secondary combustion chambers. Combustion gases generated in the primary chamber flow through the venturi to the secondary combustion chamber. The conventional venturi chamber generally has dual-walls with cooling gas passages between the walls. Cooling air enters an upstream inlet to the passage between the walls of the venturi. The cooling air flows out from an axial end of the venturi. A conventional venturi chamber is disclosed in U.S. Pat. No. 5,575,146.

Conventional dual-wall venturi chambers exhausts cooling air from the annular passage between the walls of the venturi. The air from the venturi chamber is discharged from the axial end of the venturi chamber adjacent the combustor liner wall in the secondary combustion chamber. The combustion air is discharged from the venturi in an axial direction paralleling the centerline of the combustion chamber. The air from the discharge end of the venturi flows into the secondary combustion chamber along the liner wall of the combustor and flows in a direction generally parallel to the centerline of the chamber. The air discharged from the axial end of the venturi generally flows along the surface of the liner wall and does not quickly mix with the combustion gases in the combustion chamber.

There is a long felt need for combustors having robust mixing of compressor air and combustion products. This need also exists with the gas flow through a venturi. Robust mixing of air and combustion products tends to reduce emissions, such as reduced nitrogen oxides (NOx).

BRIEF DESCRIPTION OF THE INVENTION

The invention may be embodied as a venturi for a gas turbine combustor comprising: a double wall venturi chamber having a converging section, a diverging section and a cylindrical section wherein said chamber defines a venturi zone in which compressed air, fuel and combustion products flow downstream through converging section, diverging section and cylindrical section; a cooling gas passage between the walls of the venturi chamber; at least one cooling gas inlet in an outlet wall of the venturi chamber, and at least one cooling gas outlet in an inner wall of the venturi chamber, wherein said cooling gas outlet is in at least one of the diverging and the cylindrical section, and the outlet is downstream of at least one cooling gas inlet and upstream of an axial end of the chamber. The venturi chamber is adapted to be positioned between a primary combustion chamber and a secondary combustion chamber of the combustor. The cooling gas outlet may comprise a plurality of cooling gas outlets arranged circumferentially around the inner wall of the venturi chamber such that cooling gas projects radially inward to the venturi zone or at some angle less than 90 degrees from a radial line through the venturi zone.

The invention may also be embodied as a venturi for a gas turbine combustor comprising: a double wall venturi chamber having a converging section, a diverging section and a cylindrical section wherein said chamber defines a venturi zone in which combustion products flow downstream through converging section, diverging section and cylindrical section; a cooling gas passage between the walls of the venturi chamber; a cooling gas inlet in an outlet wall of the venturi chamber, and at least one cooling gas outlet in an inner wall of the venturi chamber, wherein said cooling gas outlet is in at least one of the diverging and the cylindrical section, and the outlet projects cooling gas radially inward into the venturi zone.

Further, the invention may be embodied as a method for injecting cooling gas into a combustor having a double wall venturi chamber having a converging section, a diverging section and a cylindrical section wherein said chamber defines a venturi zone in the combustor, said method comprising: providing cooling gas to an outer wall of the venturi chamber such that the cooling gas enters inlets in the outer wall; cooling the chamber with the cooling gas flowing through a passage between the outer and an inner wall of the venturi chamber, and discharging the cooling gas from the chamber and radially inward into the combustor through an outlet in the inner wall of the venturi chamber, wherein said cooling gas outlet is upstream of an axial end of the chamber. The cooling gas may be compressed air from an axial compressor of a gas turbine and the compressed air is also directed into the combustor upstream of the converging section.

DETAILED DESCRIPTION OF THE INVENTION

Figure 1:
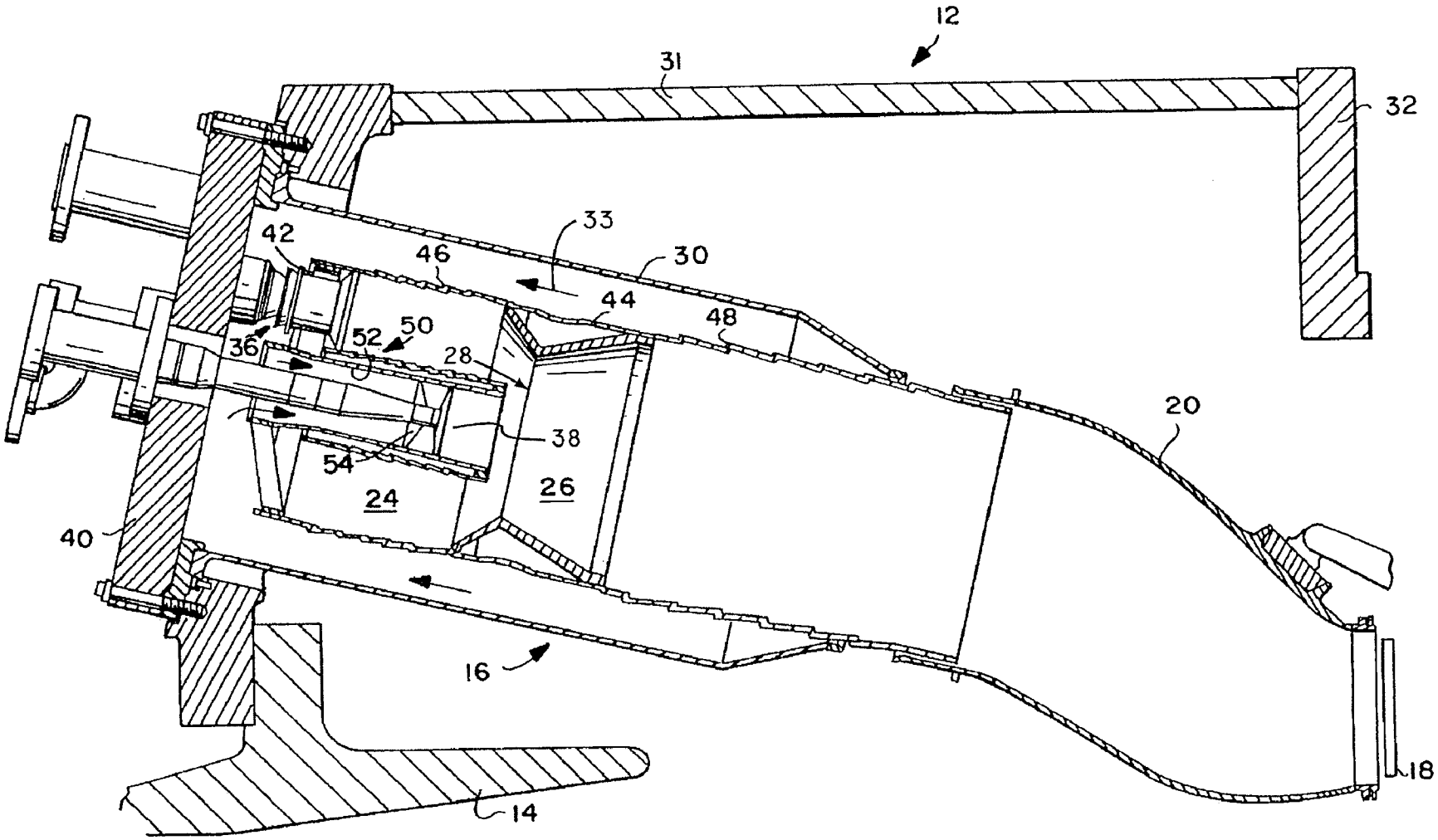
Fig. 1 (PRIOR ART)
FIG. 1 is a partial side sectional view of a conventional combustor.

FIG. 1 illustrates a conventional gas turbine 12 that includes a compressor 14 (represented by a section of a compressor casing), a combustor 16 and a turbine represented by a single blade 18. The turbine is drivingly connected to a compressor along a common axis. The compressor 14 pressurizes inlet air which is turned in a reverse direction (see arrow 33) towards the combustor 16. The compressed air cools the combustor and provides air for the combustion process ongoing in the combustor. The gas turbine includes a plurality of the generally cylindrical combustors 16 (only one shown) which are located about the periphery of the gas turbine. In one exemplary gas turbine model, there are fourteen such combustors. A transition duct 20 connects the outlet end of the combustor with the inlet end of the turbine to deliver the hot combustion gases process to the turbine.

Each combustor 16 comprises a primary or upstream combustion chamber 24 and a secondary or downstream combustion chamber 26 separated by a venturi zone 28. The combustor 16 is surrounded by a combustor flow sleeve 30 which channels compressor discharge air to the combustor. Arrows 33 show the flow of compressed air flow in a reverse direction to the combustion gas flow within the combustor. The combustor is further surrounded by an outer casing 31 which is bolted to the turbine casing 32.

Primary nozzles 36 deliver fuel to the upstream combustion chamber 24 and are arranged in an annular array around a central secondary nozzle 38. In an exemplary gas turbine, each combustor may include six primary nozzles 36 and one secondary nozzle 38. Each of the primary nozzles 36 protrudes into the primary combustion chamber 24 through a rear combustor wall 40. Secondary nozzle 38 extends from the rear wall 40 to the throat region 28 to introduce fuel into the secondary combustion chamber 26. Fuel is delivered to the nozzles 36 through fuel lines, which are not shown. Ignition in the primary combustion chamber is caused by a spark plug and associated cross fire tubes, which are not shown.

Combustion air is introduced into the fuel stage through air swirlers 42 positioned adjacent the outlet ends of nozzles 36. The swirlers 42 introduce swirling combustion air which mixes with the fuel from primary nozzles 36 to provide an ignitable mixture for combustion, on start-up, in the primary chamber 24. Combustion air for the swirlers 42 is derived from the compressor 14 and from the routing of air 33 between the combustion flow sleeve 30 and the wall 44 of the combustion chamber.

The cylindrical liner wall 44 of the combustor is provided with slots or louvers 48 in the primary combustion chamber 24, and similar slots or louvers 48 downstream of the secondary combustion chamber 26. The compressor discharge air flow through the slots or louvers cools the liner and introduces dilution air into the combustion zones 24, 26 to prevent substantial rises in flame temperature. The secondary nozzle 38 is located within a centerbody 50 and extends through a liner 52 provided with a swirler 54 through which compressor discharge air is introduced for mixing with fuel from the secondary nozzle.

Figure 2:
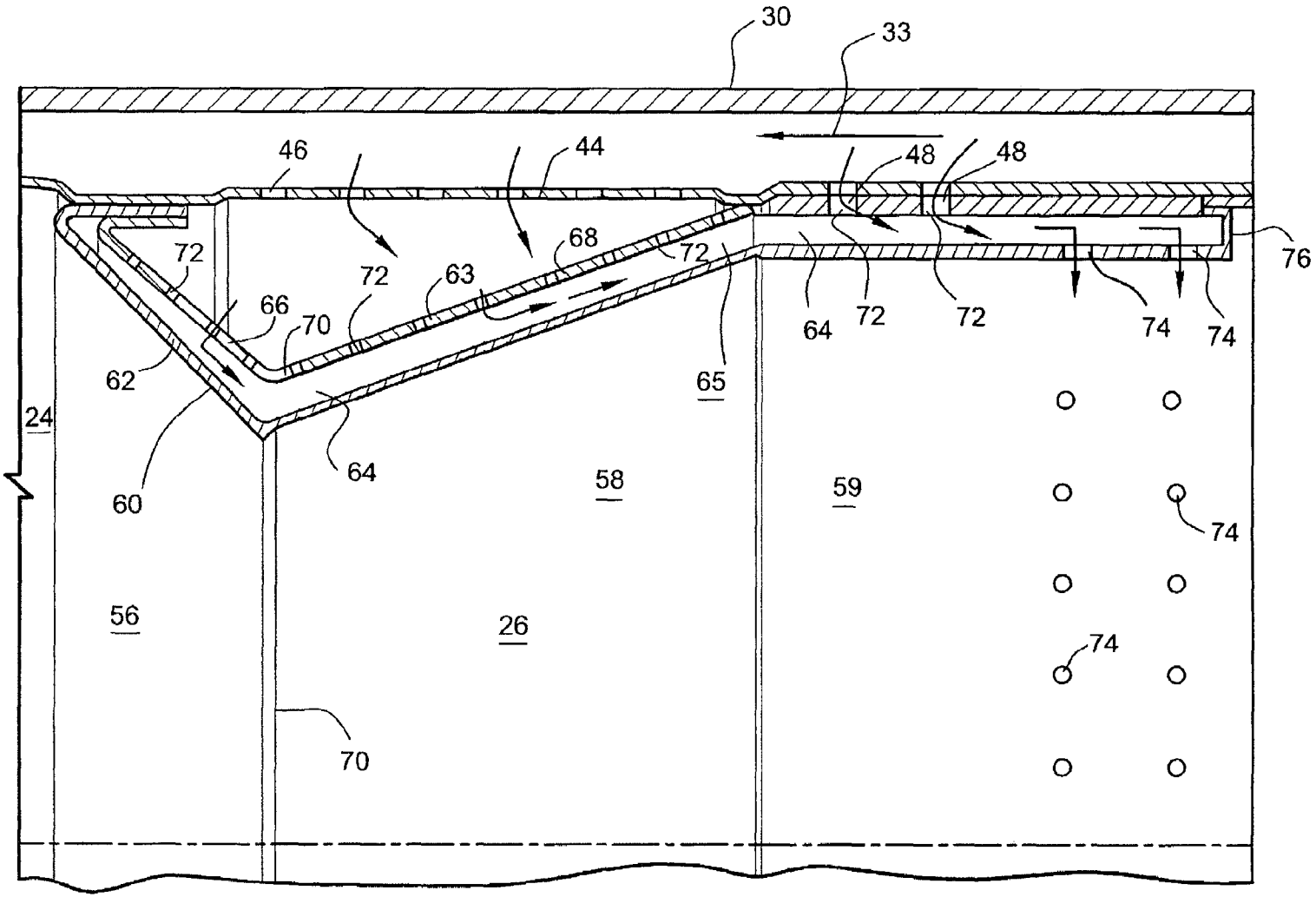
FIG. 2 is a partial side section of a venturi portion of a combustor, wherein the venturi chamber has radial outlets for injecting cooling air into the gas flow through the venturi.

FIG. 2 is an enlarged cross-sectional view of a combustor 16 showing in greater detail a venturi zone which is defined by an improved venturi chamber 60. The venturi chamber defines a throat 70 between the primary and secondary combustion chambers. The venturi chamber 60 includes an upstream converging portion 56, a diverging portion 58 and a downstream cylindrical portion 59. The double-walled venturi chamber 60 has an inner wall 62 and an outer parallel wall 63 both of which generally follow the contours of the converging and diverging portions of the venturi chamber but in radially spaced relation thereto.

A cooling passage 64 between the walls 62, 63 of the venturi cools the walls of the venturi. The walls 62, 63 may be held apart by a lattice of longitudinal internal struts 65. The outer wall is provided with a plurality of cooling inlet apertures 72 through which compressor discharge cooling air enters the venturi passage 64. The cooling air is air 33 from the compressor that flows through the sleeve 30 and through slots and louvers 46, 48 in the liner wall 44. The cooling air flows downstream and parallel to the direction of combustion gases through the passage 64 between the walls of the venturi.

Cooling air from the venturi passage 64 is discharged from an annular outlets 74 arranged on the inner wall 62 of the venturi. The annular outlets may be arranged in one or more circular arrays around the circumference of the inner wall 62. The outlets are down stream of the cooling air inlets 72 in the venturi and upstream of the axial end 76 of the venturi chamber. The relatively low pressure in the combustion chamber 26 draws air into the venturi air passage 64 from the relatively high-pressure air 33 flowing outside of the outer wall 63 of the venturi. The cooling air outlets 74 exhaust cooling air into the combustion chamber 26 in a radial direction that is substantially perpendicular to the centerline of the combustor. Alternatively, the exhaust cooling air may project from the outlets 74 into the combustion chamber at an acute angle (i.e., less than 90 degrees) from a radial line through the venturi.

The throat of the venturi chamber 60 accelerates the core combustion premixed reactants immediately upstream of the flame zone. Gas velocities in the venturi are maintained above the flame speed of the mixture to ensure that the flame front does not propagate upstream into the premixing section 24 of the combustor. Air that is used to cool the venturi travels downstream through the venturi's internal annular passage, and is discharged into the combustor reaction zone 26 in an axial direction on the outboard surface of the combustion liner. Air that has been used to cool the venturi is injected into the core combustion flow through a plurality of injection sites 74, such as slots, orifices and scoops. Injection of cooling air into the core flow is achieved by producing a series of penetrating jets, oriented in a orthogonal direction relative to the axial core flow.

The radial discharge of cooling gases from the outlets 74 of the venturi is expected to improve NOx and CO emission levels from the combustor. The radial injection of cooling air from the venturi walls should enhanced mixing of venturi cooling air with core combustor reacting gas flow and thereby reduce NOx and/or CO emissions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A venturi for a combustor comprising:

a double wall venturi chamber having an inner wall defining a converging section, a diverging section and a cylindrical section downstream of the converging and diverging sections, and said interior wall further defining a venturi zone in which compressed air, fuel and combustion products flow downstream through the converging section, diverging section and cylindrical section, wherein the inner wall is devoid of air outlets in the converging section;

an outer wall of the double wall venturi chamber;

a cooling gas passage between the outer wall and the inner wall of the venturi chamber, including through the converging section, the diverging section and the cylindrical section;

a least one cooling gas inlet in the outer wall of the venturi chamber, wherein the cooling gas inlet is proximate at least one of the converging section and the diverging section, an additional cooling gas inlet in the outer wall of the double wall venturi chamber cylindrical section; and at least one cooling gas outlet in the inner wall of the venturi chamber, wherein said cooling gas outlet is in at least one of the diverging and the cylindrical section, and the outlet is downstream of the at least one cooling gas inlet and upstream of an axial end of the venturi chamber, wherein the axial end of the chamber is devoid of a cooling gas outlet.

2. The venturi as in claim 1 wherein said venturi chamber is adapted to be positioned between a primary combustion chamber and a secondary combustion chamber of the combustor and the combustor is a gas turbine combustor.

3. The venturi as in claim 1 wherein said venturi chamber further comprises a throat region between the converging section and the diverging section, and the outer wall proximate to the diverging section is devoid of Cooling gas inlets.

4. The venturi as in claim 1 wherein the venturi chamber is circular in cross section.

5. The venturi as in claim 1 wherein the cooling gas outlet further comprises a plurality of cooling gas outlets arranged circumferentially around the cylindrical section of the inner wall of the venturi chamber.

6. The venturi as in claim 1 wherein the at least one cooling gas outlet projects cooling gas radially inward to the venturi zone.

7. The venturi as in claim 1 wherein the at least one cooling gas outlet comprises a pair of arrays of outlets each arranged circumferentially.

8. The venturi as in claim 1 wherein the outer wherein the outer wall proximate to the diverging section is devoid of cooling gas inlets.

9. The venturi as in claim 1 wherein said at least one cooling gas inlet is an array of inlets arranged circumferentially around the outer wall.

10. A venturi for a combustor comprising:

a double wall venturi chamber downstream of fuel injection in the combustor, the chamber having an inner wall defining a converging section, a diverging section and a cylindrical section, wherein the inner wall is devoid of air outlets in the converging section, and wherein said chamber defines a venturi zone in which combustion products flow downstream through converging section, diverging section and cylindrical section;

an outer wall of the double wall venturi chamber;

a cooling gas passage between the outer wall and the inner wall of the venturi chamber, including through the converging section, the diverging section and the cylindrical section;

a cooling gas inlet in the outer wall of the venturi chamber, wherein the cooling gas inlet is proximate the converging section, an additional cooling gas inlet in the outer wall of the double wall venturi chamber cylindrical section; and at least one cooling gas outlet in the inner wall of the venturi chamber and downstream of the cooling gas inlet and upstream of an axial end of the chamber, wherein said cooling gas outlet is in at least one of the diverging and the cylindrical section, and the outlet projects cooling gas radially inward into the venturi zone.

11. The venturi as in claim 10 wherein said venturi chamber is adapted to be positioned between a primary combustion chamber and a secondary combustion chamber of the combustor and the combustor is for a gas turbine.

12. The venturi as in claim 10 wherein said venturi chamber further comprises a throat region between the converging section and a diverging section.

13. The venturi as in claim 10 wherein the venturi chamber is circular in cross section.

14. The venturi as in claim 10 wherein the cooling gas outlet further comprises a plurality of cooling gas outlets arranged circumferentially around the inner wall of the venturi chamber.

15. The venturi as in claim 10 wherein at least one cooling gas outlet comprises a pair of arrays of outlets each arranged circumferentially.

16. The venturi as in claim 10 wherein said cooling gas inlet is in the converging and diverging sections of the outer wall.

17. The venturi as in claim 10 wherein said at least one cooling gas inlet is an array of inlets arranged circumferentially around the outer wall.

18. A method for injecting cooling gas into a combustor having a double wall venturi chamber downstream of fuel injection in the combustor, wherein the chamber has a converging section, a diverging section and a cylindrical section wherein said chamber defines a venturi zone in the combustor, said method comprising:

providing cooling gas to an outer wall of the double wall of the venturi chamber such that the cooling gas enters inlets in the outer wall proximate to the converging section of the venturi chamber and an additional inlet proximate the cylindrical section in the outer wall of the double wall of the venturi chamber;

defining a cooling passage having a substantially constant width between an inner wall and an outer wall of the double wall of the venturi chamber, wherein the cooling passage extends from the converging section to the diverging section of the venturi chamber and the cylindrical section;

cooling the chamber with the cooling gas flowing through the cooling passage between the outer and an inner wall of the venturi chamber, and discharging the cooling gas from the chamber and radially inward into the combustor through an outlet in the inner wall of the venturi chamber, wherein said cooling gas outlet is upstream of an axial end of the chamber.

19. The method of claim 18 wherein said cooling gas is compressed air from an axial compressor of a gas turbine and the compressed air is also directed into the combustor upstream of the converging section.

20. The method of claim 18 wherein the cooling gas outlet further comprises a plurality of cooling gas outlets arranged circumferentially around the inner wall of the venturi chamber, the cooling gas is discharged radially inward from each of the outlets and the outer wall proximate to the diverging section is devoid of cooling gas inlets.

* * * * *

UNITED STATES PATENT AND TRADEMARK OFFICE

CERTIFICATE OF CORRECTION

PATENT NO. : 7,389,643 B2
APPLICATION NO. : 11/045057
DATED : June 24, 2008
INVENTOR(S) : Derrick Simons et al.

It is certified that error appears in the above-identified patent and that said Letters Patent is hereby corrected as shown below:

In column 5, line 4 please delete the first occurrence of the phrase "wherein the outer"

Signed and Sealed this

Twelfth Day of August, 2008

JON W. DUDAS
*Director of the United States Patent and Trademark Office*